US008957842B2

(12) United States Patent
Yen et al.

(10) Patent No.: US 8,957,842 B2
(45) Date of Patent: Feb. 17, 2015

(54) PIXEL CIRCUITRY OF DISPLAY DEVICE

(71) Applicant: Himax Display, Inc., Tainan (TW)

(72) Inventors: Cheng-Chi Yen, Tainan County (TW); Wei-Ting Lan, Tainan County (TW); Hon-Yuan Leo, Tainan County (TW)

(73) Assignee: Himax Display, Inc., Tainan (TW)

( * ) Notice: Subject to any disclaimer, the term of this patent is extended or adjusted under 35 U.S.C. 154(b) by 0 days.

(21) Appl. No.: 14/072,547

(22) Filed: Nov. 5, 2013

(65) Prior Publication Data

US 2014/0062992 A1 Mar. 6, 2014

Related U.S. Application Data

(62) Division of application No. 12/831,410, filed on Jul. 7, 2010, now abandoned.

(51) Int. Cl.
*G09G 3/36* (2006.01)

(52) U.S. Cl.
CPC ..... *G09G 3/3611* (2013.01); *G09G 3/3648* (2013.01); *G09G 3/3659* (2013.01); *G09G 2300/0833* (2013.01); *G09G 2300/0842* (2013.01)
USPC ..... 345/90

(58) Field of Classification Search
CPC ..... G09G 3/36
USPC ..... 345/84, 204, 690, 698, 90; 315/169.1–169.3
See application file for complete search history.

(56) References Cited

U.S. PATENT DOCUMENTS

| | | | | |
|---|---|---|---|---|
| 6,278,426 | B1 * | 8/2001 | Akiyama | 345/87 |
| 6,331,844 | B1 * | 12/2001 | Okumura et al. | 345/87 |
| 6,480,178 | B1 * | 11/2002 | Itakura et al. | 345/89 |
| 8,305,313 | B2 * | 11/2012 | Furuya et al. | 345/87 |
| 2004/0000876 | A1 * | 1/2004 | Yang | 315/169.1 |

* cited by examiner

*Primary Examiner* — Pegeman Karimi
(74) *Attorney, Agent, or Firm* — J.C. Patents

(57) ABSTRACT

A pixel circuitry of a display device is provided to make a voltage level transmitted to a display element be close to a voltage level of a received data voltage, such that the pixel circuitry faithfully transmits the data voltage to the display element. The pixel circuitry of a display device includes a first write switch, a first write memory unit, a first voltage following module, and a display element. The first voltage following module is to detect a first data voltage stored in the first write memory unit, and to generate a corresponding first output voltage at a terminal of the display element based on a detection result. A first output terminal of the first voltage following module is controlled by a switching voltage.

11 Claims, 9 Drawing Sheets

500

PIXEL CIRCUITRY OF DISPLAY DEVICE

CROSS-REFERENCE TO RELATED APPLICATION

This application is a Divisional of and claims the priority benefit of U.S. patent application Ser. No. 12/831,410, filed on Jul. 7, 2010, now pending. The entirety of the above-mentioned patent application is hereby incorporated by reference herein and made a part of this specification.

BACKGROUND OF THE INVENTION

1. Field of the Invention

The present invention relates to a pixel circuitry, and more particularly, to a pixel circuitry of a display device.

2. Description of Related Art

Flat panel displays, such as liquid crystal displays (LCDs), have the advantages of high resolution, small volume, light weight, low drive voltage, and low power consumption, and thus are widely used in various consumer communication products or electronic devices, for example, video recorders and players, personal digital assistants (PDAs), mobile phones, notebook computers, desktop displays, and thin digital TVs, and have become the mainstream of display devices, gradually replacing Cathode Ray Tubes (CRT).

In a general flat display device, the flat display panel consists of pixel arrays, and the pixel array includes a plurality of pixel circuitries. Since the traditional pixel circuitry mainly consists of passive elements, such as a capacitor, or a switch, etc., it is unavoidable that a charge sharing occurs during image data transmission. Thus, a data signal received by a display element of the pixel circuitry has some variations which results in an unexpected condition in displaying pixels, for example, a gray level departure or distortion between a gray level actual displayed by the pixel and an expected gray level of the pixel driven by the data signal. The charge sharing usually occurs in a digital logic circuitry, and since there are coupled capacitors between internal elements of the circuitry, a voltage or a voltage level of the signal to be output by the circuitry is reduced.

SUMMARY OF THE INVENTION

The invention provides a pixel circuitry of a display device in which a voltage level of a pixel voltage is close to that of an image data voltage received by the pixel circuitry, such that the image data voltage is faithfully transmitted to the display element, and the charge sharing among coupled capacitors of elements is reduced.

The invention provides a pixel circuitry of a display device which includes a first write switch, a first write memory unit, a voltage following module, and a display element. The first write switch has a first terminal coupled to a data line, and the first write switch is controlled by a first switching voltage. The first write memory unit is coupled to a second terminal of the first write switch, wherein the first write memory unit stores a first data voltage through the first write switch. The first voltage following module has an input terminal coupled to the first write memory unit to detect the first data voltage stored in the first write memory unit and to generate a first output voltage correspondingly at an output terminal of the first voltage following module according to a detection result. The output terminal of first voltage following module is controlled by a second switching voltage. The display element is coupled to the output terminal of the first voltage following module to receive the first output voltage through the first voltage following module during a frame period.

In an embodiment of the invention, the first voltage following module includes a first voltage follower and a first display switch. The first voltage follower has an input terminal serving as the input terminal of the first voltage following module. The first display switch has a first terminal coupled to an output terminal of the first voltage follower, and a second terminal of the first display switch serves as the output terminal of the first voltage following module. Besides, the first display switch is controlled by the second switching voltage.

In an embodiment of the invention, the first voltage follower includes an operational amplifier. A first input terminal of operational amplifier serves as the input terminal of the first voltage follower, and an output terminal of the operational amplifier is coupled to a second input terminal of the operational amplifier so as to serve as the output terminal of the first voltage follower.

In an embodiment of the invention, the first voltage follower includes a source follower. The source follower includes a first transistor and a second transistor. The first transistor has a control terminal which serves as an input terminal of the source follower. A first terminal of the first transistor receives a system voltage, and a second terminal of the first transistor serves as an output terminal of the source follower. The second transistor has a control terminal which receives a control voltage. A first terminal of the second transistor receives a common voltage, and a second terminal of the second transistor is coupled to the second terminal of the first transistor.

In an embodiment of the invention, the first voltage following module includes a first voltage follower and a first power control switch. The first voltage follower has an input terminal which serves as the input terminal of the first voltage following module, and an output terminal of the first voltage follower serves as the output terminal of the first voltage following module. The first power control switch has a first terminal coupled to a power input terminal of the first voltage follower, and a second terminal of the first power control switch receives a system voltage. The first power control switch is controlled by the second switching voltage.

In an embodiment of the invention, the pixel circuitry of a display device further includes a display memory unit coupled to the output terminal of the first voltage following module. Herein, the display memory unit includes a second capacitor having a first terminal coupled to the output terminal of the first voltage following module, and a second terminal of the second capacitor receives a second reference voltage.

In an embodiment of the invention, the pixel circuitry of a display device further includes a first shorting switch. The first shorting switch has a first terminal coupled to the first write memory unit, a second terminal of the first shorting switch is coupled to the display element. The first shorting switch is controlled by a first shorting voltage.

In an embodiment of the invention, the pixel circuitry of a display device further includes a second write switch, a second write memory unit, and a second voltage following module. The second write switch has a first terminal coupled to the data line, and the second write switch is controlled by a third switching voltage. The second write memory unit is coupled to a second terminal of the second write switch, wherein the second write memory unit stores a second data voltage through the second write switch. The second voltage following module has an input terminal coupled to a first terminal of the second write memory unit. An output terminal of the second voltage following module is coupled to the display element so as to detect the second data voltage stored in the second write memory unit and to generate a second output voltage correspondingly at the output terminal of the second voltage following module according to a detection result. The output terminal of the second voltage following module is controlled by a fourth switching voltage.

In an embodiment of the invention, the second voltage following module includes a second voltage follower and a second display switch. The second voltage follower has an input terminal serving as the input terminal of the second voltage following module. The second display switch has a first terminal coupled to an output terminal of the second voltage follower, and a second terminal of the second display switch serves as the output terminal of the second voltage following module. The second display switch is controlled by the fourth switching voltage.

Based on the above, in the embodiments of the invention, by adopting the voltage following module which mainly includes an active element (e.g. an operational amplifier, or a source driver, etc.), the voltage level of the display element is about equal to the voltage level of an image data voltage without being affected by coupled capacitors and the charge sharing when the pixel circuitry transmits the data voltage.

In order to make the aforementioned and other features and advantages of the invention more comprehensible, embodiments accompanying figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
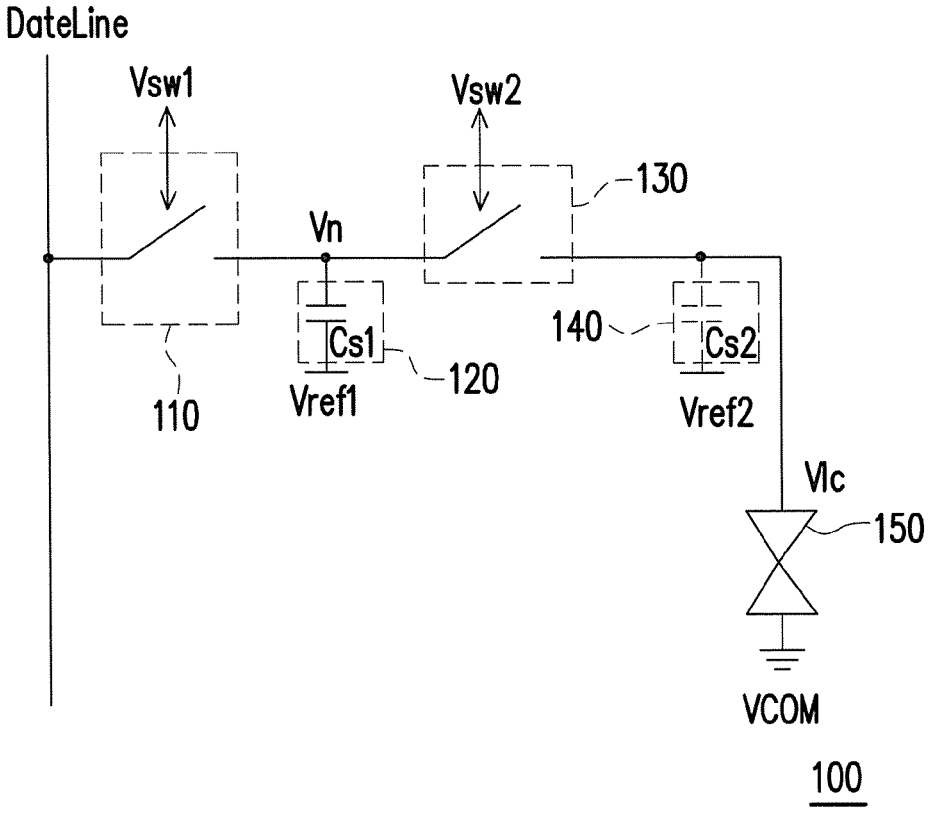
FIG. 1 is a schematic circuit diagram of a pixel circuitry of a display device according to the first embodiment of the invention.

Herein the first embodiment of a pixel circuitry 100 for a display device is provided. Please refer to FIG. 1. FIG. 1 is a schematic circuit diagram of the pixel circuitry 100 of a display device according to the first embodiment of the invention. The pixel circuitry 100 of a display device includes a first write switch 110, a first write memory unit 120, a first display switch 130, and a display element 150. The first write switch 110 has a first terminal coupled to a data line DataLine, and the first write switch 110 is controlled by a first switching voltage Vsw1. A first terminal of the first write memory unit 120 is coupled to a second terminal of the first write switch 110, and a second terminal of the first write memory unit 120 receives a first reference voltage Vref1. The first write memory unit 120 stores a first data voltage through the first write switch 110. A first terminal of the first display switch 130 is coupled to the first write memory unit 120, wherein the first display switch 130 is controlled by a second switching voltage Vsw2. The display element 150 is coupled to a second terminal of the first display switch 130, and another terminal of the display element 150 receives a common voltage Vcom. The display element 150 receives the first data voltage stored in the first memory unit 120 through the first display switch 130 according to the second switching voltage Vsw2 during a frame period.

Figure 2:
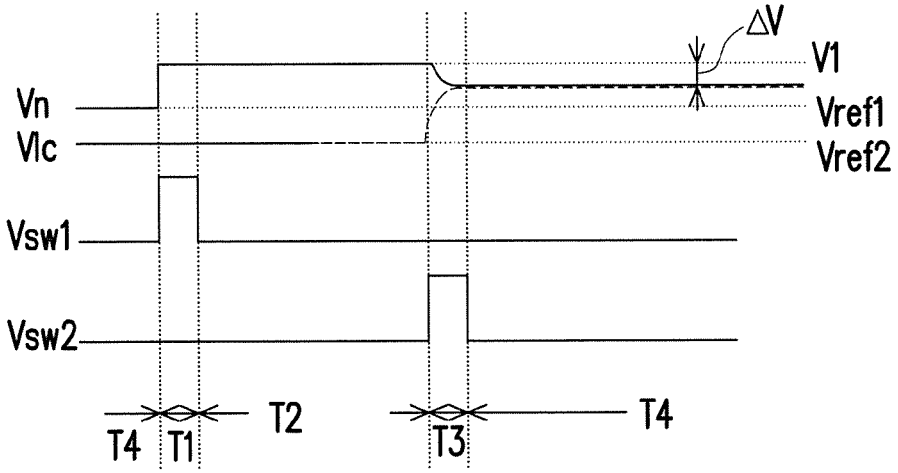
FIG. 2 is a timing diagram of driving signals of the pixel circuitry of a display device according to the first embodiment of the invention.

In the embodiment, the pixel circuitry 100 further includes a display memory unit 140. A first terminal of the display memory unit 140 is coupled to the second terminal of the first display switch 130, and a second terminal of the display memory unit 140 receives a second reference voltage Vref2. Besides, the display element 150 of the embodiment is, for example, a liquid crystal (LC) capacitor 150. The LC capacitor 150 is driven by the voltage difference between a pixel voltage Vlc and the common voltage Vcom, and tilt angles of LC molecules in the LC capacitor 150 are changed according to the voltage difference. For a clear description the operation of the embodiment, please refer to both FIG. 1 and FIG. 2. FIG. 2 is a timing diagram of driving signals of the pixel circuitry 100 of a display device according to the first embodiment of the invention. In the following, a voltage at the second terminal of the first write switch 110 coupled to the first write memory unit 120 is called a terminal voltage Vn. According to the embodiment, each frame period of the driving time is mainly divided into four periods, i.e. a write period T1, a waiting display period T2, a display period T3, and a waiting write period T4. The write period T1 is a period during which the first switching voltage Vsw1 is at a high level, while the second switching voltage Vsw2 is at a low level. Thus, the write period T1 is also a period during which the first write switch 110 is turned on, and the first display switch 130 is turned off. A first capacitor Cs1 in the first write memory unit 120 receives the first data voltage V1 from the data line DataLine through the first write switch 110, and then the first capacitor Cs1 begins to store charges during this time so that the terminal voltage Vn equals to the first data voltage V1. It should be noted that the circuit analysis result "the terminal voltage Vn equals to the first data voltage V1" is in ideal condition. The terminal voltage Vn is smaller than the first data voltage V1 in real condition if non-ideal characteristic of circuit/device (e.g. voltage drop of the switch 110) is considered.

Then, the process enters the waiting display period T2. The waiting display period T2 is a period during which the first switching voltage Vsw1 and the second switching voltage Vsw2 are both at low level, and is also a period during which the first write switch 110 and the first display switch 130 are both turned off. At this time, the voltage level of the terminal voltage Vn is kept at a voltage level equals to that of the first data voltage V1 by the first capacitor Cs1 of the first write memory unit 120.

Afterwards, the process enters the display period T3. The display period T3 is a period during which the second switching voltage Vsw2 is at a high level, while the first switching voltage Vsw1 is at a low level. Thus, the display period T3 is also the period during which the first display switch 130 is turned on, and the first write switch 110 is turned off. Ideally, the first data voltage V1 should be fully transmitted to the display element. That is to say, after the first display switch 130 is turned on, the pixel voltage Vlc of the display element 150 should equal to the first data voltage V1. However, due to a charge sharing, charges stored in the first capacitor Cs1 are evenly distributed among the first capacitor Cs1, the second capacitor Cs2 of the display memory unit 140, and the LC capacitor 150, which causes the pixel voltage Vlc of the display element 150 not to be equal to the first data voltage V1. That is to say, there is a voltage difference ΔV between the pixel voltage Vlc and the first data voltage V1. For reducing an unexpected condition in pixels of the pixel circuitry 100, e.g. a gray level departure or distortion between a display value of the pixel and an expected value of the pixel when being driven by the data voltage V1, the voltage difference ΔV need to be as small as possible.

Then, the process enters the waiting write period T4. The waiting write period T4 is similar to the waiting display period T2. At this time, the first switching voltage Vsw1 and the second switching voltage Vsw2 are at a low level, and the first write switch 110 and the first display switch 130 are turned off. Thus, a voltage difference to drive the LC capacitor 150 is continuously provided by the display memory unit 140 and the LC capacitor 150 until the next write period T1 of the next frame. In another embodiment, the display memory unit 140 may be omitted depends on actual demands, and the data voltage is stored by the LC capacitor 150 itself.

According to the embodiment, since the voltage difference ΔV exists between the pixel voltage Vlc for driving the LC capacitor 150 and the first data voltage V1 in the pixel circuitry 100, the tile angles of LC molecules in the LC capacitor 150 are not capable of being accurately changed according to the first data voltage V1. In order to reduce the voltage difference ΔV, the capacitance of the first capacitor Cs1 may be increased to a value much greater than the capacitance of the second capacitor Cs2 plus that of the LC capacitor 150, so that the voltage difference ΔV is reduced when the charge sharing occurs. However, due to the limitation of the current manufacturing process and the demand of device miniaturization, the capacitance of the first capacitor Cs1 is near to that of the second capacitor Cs1 plus that of the LC capacitor gradually, such that the voltage difference ΔV is increased to an extent that can not be ignored.

Figure 3:
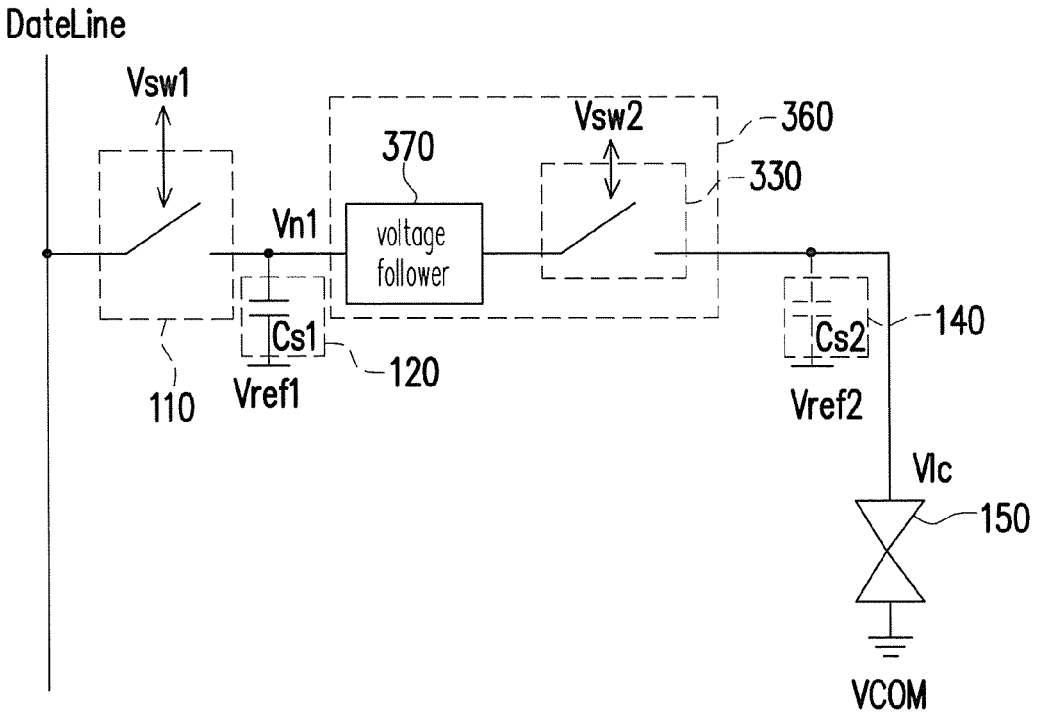
FIG. 3 is a schematic circuit diagram of a pixel circuitry of a display device according to the second embodiment of the invention.

Accordingly, the second embodiment of the invention is provided to decrease the voltage difference ΔV and reduce the charge sharing. Please refer to FIG. 3, FIG. 3 is a schematic circuit diagram of a pixel circuitry 300 of a display device according to the second embodiment of the invention. The pixel circuitry 300 includes a first write switch 110, a first write memory unit 120, a first voltage following module 360, and a display element 150. Herein, the pixel circuitry 300 of the embodiment is similar to the pixel circuitry 100 of the first embodiment, and thus descriptions of the same connection scheme and operation are not repeated. In order to make a detailed description of the embodiment, an input terminal voltage of the first voltage following module 360 is called a terminal voltage Vn1, and an output terminal of the first voltage following module 360 is coupled to the LC capacitor 150, such that a first output voltage of the first voltage following module 360 equals to the pixel voltage Vlc.

The difference between the pixel circuitry 100 and pixel circuitry 300 lies in that the pixel circuitry 300 includes a first voltage following module 360. An input terminal of the first voltage following module 360 is coupled to the first write memory unit 120 so as to detect a first data voltage stored in the first write memory unit 120, and a corresponding first output voltage is output at the output terminal of the first voltage following module 360 according to a detection result. Herein the output terminal of the first voltage following module 360 is controlled by a second switching voltage Vsw2. According to the embodiment, an active element (e.g. an operational amplifier, or a source follower, etc.) is adopted in the first voltage following module 360 which faithfully generates the output voltage (i.e. the pixel voltage Vlc) according to the first input terminal voltage Vn1 which is detected and then transmits the first output voltage to the display element 150, so that the voltage difference ΔV due to the charge sharing is reduced as much as possible.

The display element 150 is coupled to the output terminal of the first voltage following module 360 to receive the first output voltage through the first voltage following module 360 during a frame period. In the embodiment, the first voltage following module 360 includes a first voltage follower 370 and a first display switch 330. An input terminal of the first voltage follower 370 serves as the input terminal of the first voltage following module 360. A first terminal of the first display switch 330 is coupled to an output terminal of the first voltage follower 370, and a second terminal of the first display switch 330 serves as the output terminal of the first voltage following module 360. Besides, the first display switch 330 is controlled by the second switching voltage Vsw2. In the embodiment, the first write memory unit 120 includes a first capacitor Cs1, and the display memory unit 140 includes a second capacitor Cs2.

Figure 4:
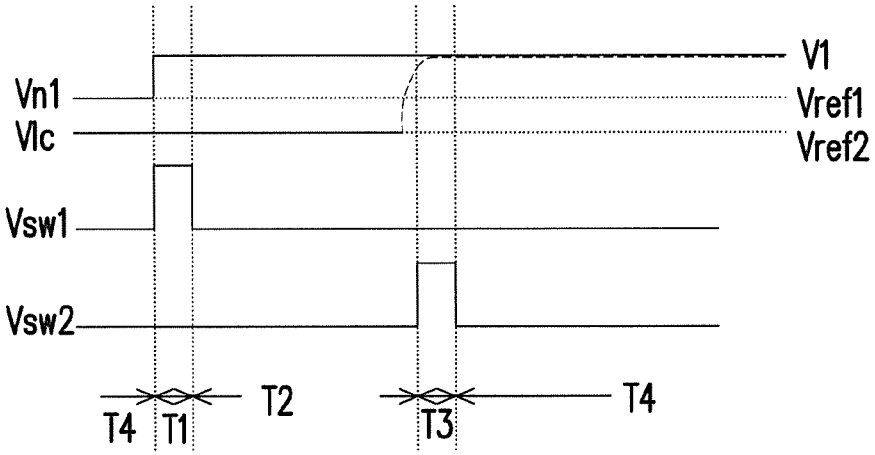
FIG. 4 is a timing diagram of driving signals of the pixel circuitry of a display device according to the second embodiment of the invention.

In order to make those of ordinary skill in the art further comprehend the invention, the following illustrates the difference of the operation between the pixel circuitry 100 of FIG. 1 and the pixel circuitry 300 of FIG. 3, and the same operations of the two are omitted. Referring to FIG. 4, FIG. 4 is a timing diagram of driving signals of the pixel circuitry 300 of a display device according to the second embodiment of the invention. During a display period T3 of each frame period, a second switching voltage Vsw2 is at a high level, and a first switching voltage Vsw1 is at a low level. Accordingly, during the display period T3, the first display switch 130 is turned on, and the first write switch 330 of the first voltage follower module 360 is turned off. Based on the description as above mentioned, the input terminal voltage (i.e. the terminal voltage Vn1) of the first voltage following module 360 utilizes the first capacitor Cs1 to maintain the voltage level, and the voltage level of the terminal voltage Vn1 is equal to the voltage level of the first data voltage V1 at this time. It should be noted that the circuit analysis result "the terminal voltage Vn1 equals to the first data voltage V1" is in ideal condition.

The terminal voltage Vn1 is smaller than the first data voltage V1 in real condition if non-ideal characteristic of circuit/device (e.g. voltage drop of the switch 110) is considered.

In ideal condition, the first voltage follower 370 of the first voltage following module 360 correspondingly generates a first output voltage having the voltage level equal to the voltage level of the first data voltage V1 according to the terminal voltage Vn1 having the voltage level equal to the voltage level of the first data voltage V1. However, the voltage level of the first output voltage may be different to the voltage level of the first data voltage V1 if non-ideal characteristic of the first voltage follower 370 is considered. Thus, when the first display switch 330 is turned on, the output terminal of the first voltage follower 370 is able to be coupled to the display element 150, so that the voltage level of the pixel voltage Vlc is equal to about the voltage level of the first output voltage (i.e. the first data voltage V1). During the display period T3, the display memory unit 140 also stores charges so as to maintain the voltage level of the first data voltage V1.

Then, during the waiting write period T4, the first write switch 110 and the firsts display switch 330 are turned off. The display memory unit 140 then utilizes the charges stored in the second capacitor Cs2 to maintain the voltage level of the pixel voltage Vlc as about the voltage level of the first data voltage V1 so as to provide the voltage difference required which is used to drive the LC capacitor 150 until the next write period T1 of the next frame period.

Figure 5:
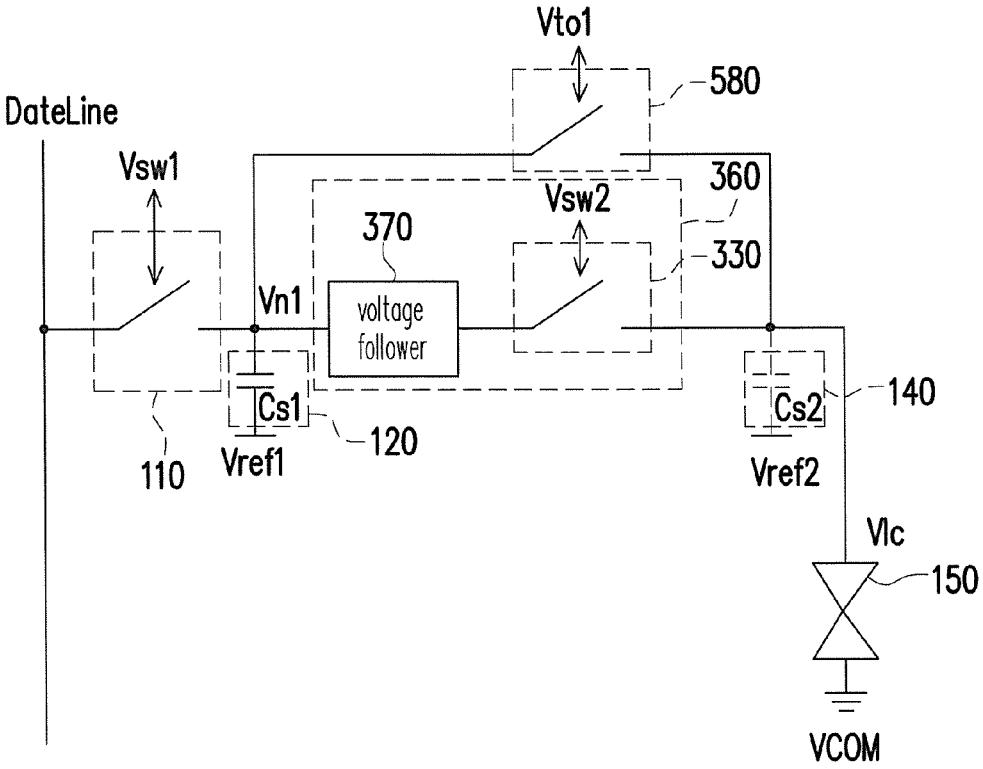
FIG. 5 is a schematic circuit diagram of a pixel circuitry of a display device according to the third embodiment of the invention.
Figure 6:
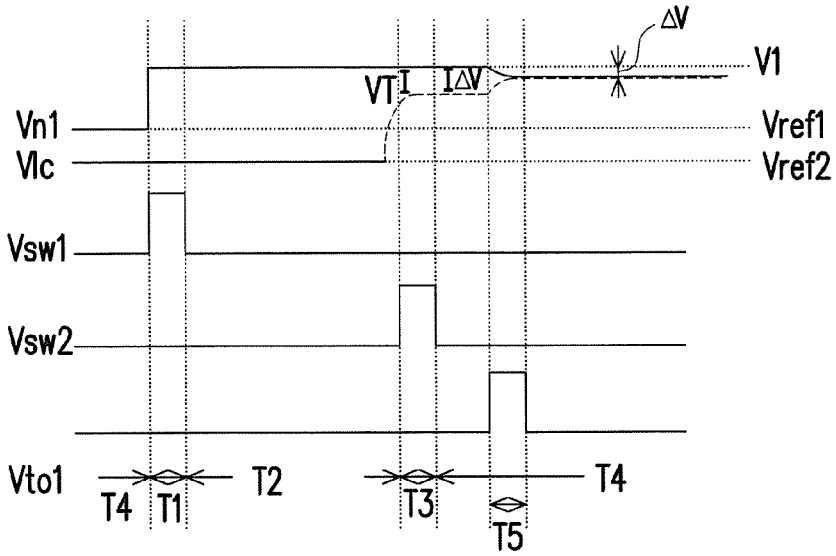
FIG. 6 is a timing diagram of driving signals of the pixel circuitry of a display device according to the third embodiment of the invention.

The embodiment utilizes the first voltage following module 360 to faithfully transmit the first data voltage V1 from the input terminal of the first voltage following module 360 to the display element 150, such that the voltage difference ΔV is reduced. Ideally, the output voltage of the first voltage follower 370 may be set to a voltage equal to the terminal voltage Vn1 (i.e. the first data voltage V1). However, there is some error or shift value in the realistic voltage follower 370. In another embodiment, the error or shift value of the output can be solved by adding a transmission switch which is used to conduct the two terminals of the first voltage following module 360, so that the voltage level of the pixel voltage Vlc is able to be closer to a target voltage level (i.e. the voltage level of the first data voltage V1). That is to say, the voltage difference ΔV is decreased. Please refer to FIG. 5 and FIG. 6. FIG. 5 is a schematic circuit diagram of a pixel circuitry 500 of a display device according to the third embodiment of the invention, and FIG. 6 is a timing diagram of driving signals of the pixel circuitry 500 of a display device according to the third embodiment of the invention. Herein, the pixel circuitry 500 of the embodiment is similar to the pixel circuitry 300 of the second embodiment, and thus descriptions of the same connection scheme and the operation are not repeated.

The difference between the pixel circuitry 500 of the embodiment and the pixel circuitry 300 of the second embodiment of FIG. 3 lies in that the pixel circuitry 500 further includes a first shorting switch 580. A first terminal of the first shorting switch 580 is coupled to a first write memory unit 120, and a second terminal of the first shorting switch 580 is coupled to a display element 150. Besides, the first shorting switch 580 is controlled by a first shorting voltage Vto1. In the embodiment, there is an offset voltage Vt between an output terminal of the first voltage following module 360 and an input terminal of the first following module 360. For example, during the display period T3, the first output voltage (i.e. the pixel voltage Vlc) of the voltage following module 360 should ideally equal to the first input terminal voltage (i.e. the first data voltage V1), while actually, the pixel voltage Vlc is equal to the first voltage data minus the offset voltage Vt of the first voltage following module 360. When the voltage difference ΔV (ΔV=Vt during the display period T3) between the first data voltage V1 and the pixel voltage Vlc is too great to be ignored, the first shorting switch 580 is adopted in the embodiment so as to reduce the voltage difference ΔV. The following are detailed descriptions of the embodiment of the invention.

Accordingly, in the embodiment, a shorting period T5 is inserted in the write waiting period T4 of the driving timing, and the first shorting voltage Vto1 is at a high level at this time. Thus, the first shorting switch 580 is turned on, while the first write switch 110 and the first display switch 330 are both turned off. At this moment, two terminals of the first shorting switch 580 are connected with each other resulting in the charge sharing, so that the pixel voltage Vlc is further closer to the first data voltage V1 and the voltage difference ΔV is further reduced.

Figure 7:
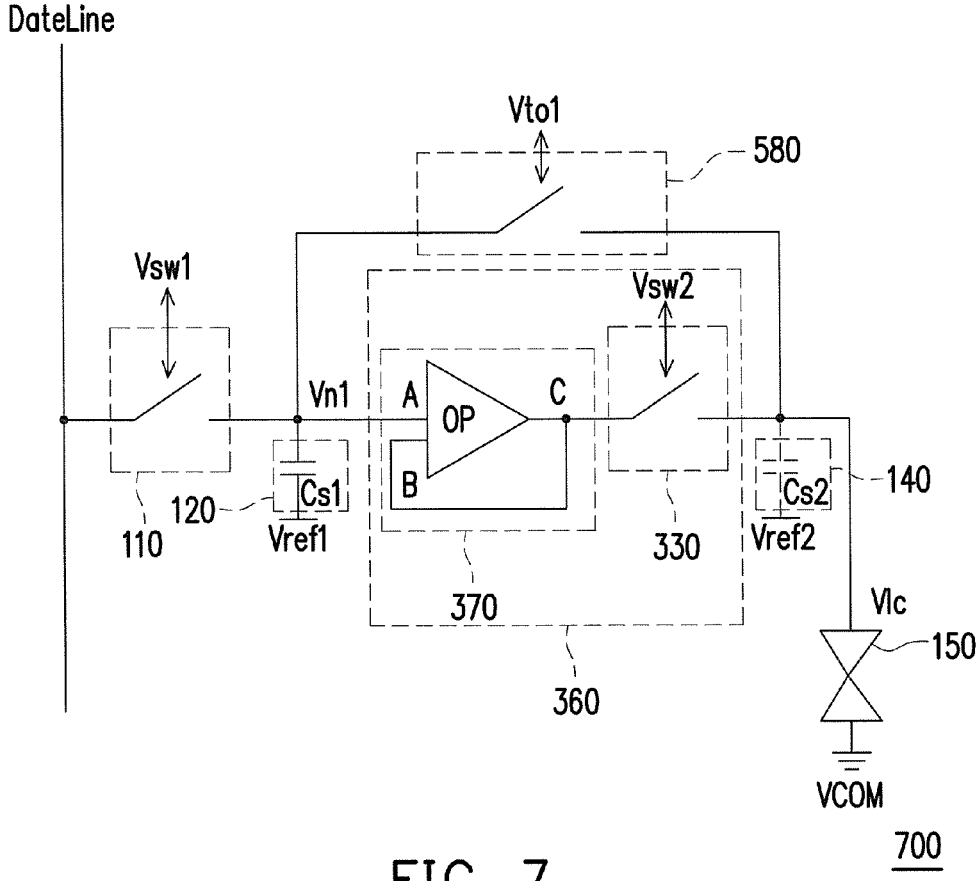
FIG. 7 is a schematic circuit diagram of a pixel circuitry of a display device according to the fourth embodiment of the invention.

To further illustrate embodiments of the invention, the following is the description of a circuit configuration of the first voltage following module 360. Referring to FIG. 7, FIG. 7 is a schematic circuit diagram of a pixel circuitry 700 of a display device according to the fourth embodiment of the invention. Herein, the pixel circuitry 700 of the embodiment is similar to the pixel circuitry 500 of the third embodiment, and thus descriptions of the same connection scheme and the operation are not repeated.

The difference between the pixel circuitry 700 and the pixel circuitry 500 of FIG. 5 lies in that the first voltage follower 370 includes an operational amplifier OP. A first input terminal A (e.g. a non-inverting input terminal) of the operational amplifier OP serves as the input terminal of the first voltage follower 370, an output terminal C of the operational amplifier OP is coupled to a second input terminal B (e.g. an inverting input terminal) of the operational amplifier OP and serves as the output terminal of the first voltage follower 370. Thus, the operational amplifier OP detects a voltage level of the first input terminal A (i.e. the terminal voltage Vn1) and generates a corresponding voltage level at the output terminal C so as to achieve at least one of objects of the embodiment. Those with ordinary skill in the art may achieve the above mentioned function by implementing the circuit configuration of the operational amplifier OP according to actual requirements from the teachings of the embodiment.

Figure 8:
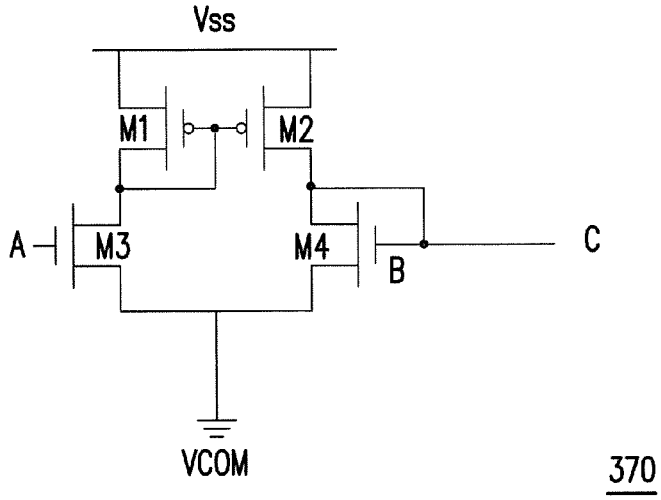
FIG. 8 is a schematic circuit diagram of a first voltage follower according to the fourth embodiment of the invention.

In the embodiment, a detailed circuit diagram of the operational amplifier OP is depicted in FIG. 8. FIG. 8 is a schematic circuit diagram of a first voltage follower according to the fourth embodiment of the invention. The operational amplifier OP includes a first operational transistor M1, a second operational transistor M2, a third operational transistor M3, and a fourth operational transistor M4. Herein, the first operational transistor M1 and the second operational transistor M2 of the embodiment are P-channel metal oxide semiconductor (PMOS) transistors, and the third operational transistor M3 and the fourth operational transistor M4 are N-channel metal oxide semiconductor (NMOS) transistors.

A system voltage Vss is received by a first terminal (e.g. a source terminal) of the first operational transistor M1, and a second terminal (e.g. a drain terminal) of the first operational transistor M1 is coupled to a control terminal (e.g. a gate terminal) of the first operational transistor M1. The system voltage Vss is received by a first terminal (e.g. a source terminal) of the second operational transistor M2, and a control terminal (e.g. a gate terminal) of the second operational transistor M2 is coupled to the control terminal (e.g. a gate terminal) of the first operational transistor M1. A first terminal (e.g. a drain terminal) of the third operational transistor M3 is coupled to a control terminal (e.g. a gate terminal) of the first operational transistor M1, and a common voltage Vcom is received by a second terminal (e.g. a source terminal) of the third operational transistor M3. A control terminal (e.g. a gate terminal) of the third operational transistor M3 serves as the input terminal of the operational amplifier OP. A first terminal (e.g. a drain terminal) of the fourth operational transistor M4 is coupled to a control terminal (e.g. a gate terminal) of the fourth operational transistor M4 and the second terminal (e.g. a drain terminal) of the second operational amplifier M2 so as to serve as the output terminal of the operational amplifier OP. The common voltage Vcom is received by a second terminal (e.g. a source terminal) of the fourth operational transistor M4. Another operation of the operational amplifier OP which is not illustrated is apparent to one of the ordinary skills in the art, and thus is not repeated herein. Those of the ordinary art in the field may replace the operational amplifier OP with another operational amplifier having the function same as that of the operational amplifier OP according to actual requirements so as to achieve at least one of objects of the embodiment.

Figure 9:
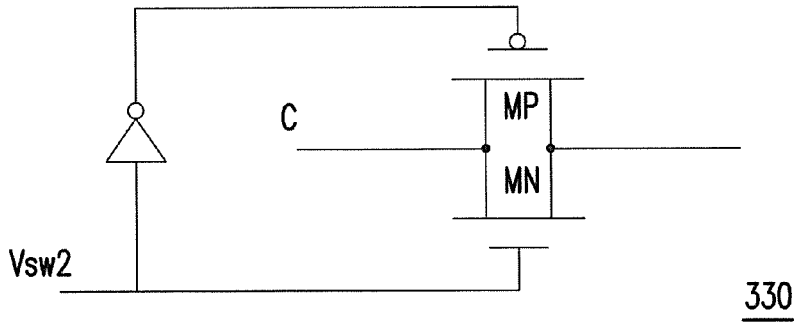
FIG. 9 is a schematic circuit diagram of a first display switch according to the fourth embodiment of the invention.

Furthermore, those of the ordinary art in the field may also design the first write switch 110, the first display switch 330, and the first shorting switch 580 according to actual requirements so as to achieve at least on of the above mentioned functions. Take the first display switch 330, for example, referring to FIG. 9. FIG. 9 is a schematic circuit diagram of the first display switch 330 according to the fourth embodiment of the invention. The first display switch 330 of the embodiment is, for example, consists of an NMOS transistor MN and a PMOS transistor MP, and is controlled by the second switching voltage Vsw2. Another operation of the first display switch 330 which is not illustrated is apparent to one of the ordinary skills in the art. For example, in another embodiment, a single transistor may be adopted to implement the first display switch 330, and further description is omitted hereinafter.

Figure 10:
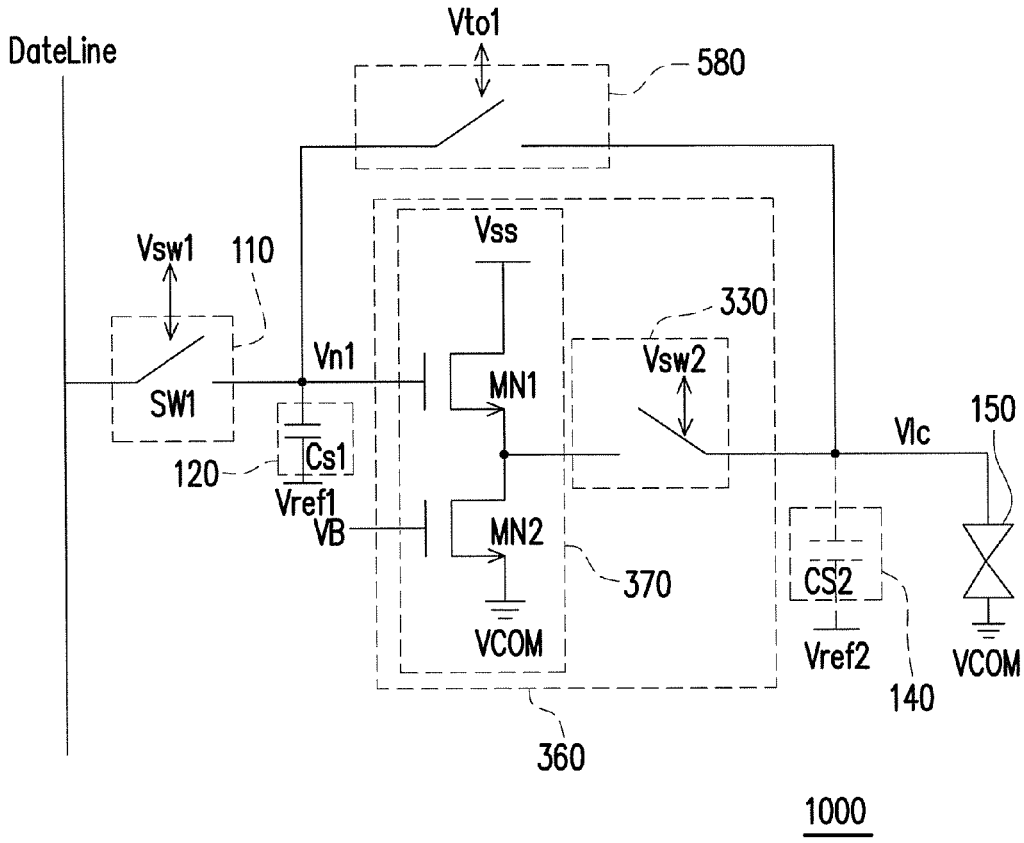
FIG. 10 is a schematic circuit diagram of a pixel circuitry of a display device according to the fifth embodiment of the invention.

In another embodiment, a source follow may be adopted to implement the first voltage follower 370. Please refer to FIG. 10. FIG. 10 is a schematic circuit diagram of a pixel circuitry of a display device according to the fifth embodiment of the invention. The embodiment is similar to the third embodiment, and thus descriptions of the same connection scheme and the operation are not repeated. The first voltage follower 370 of the pixel circuitry 1000 includes a first transistor MN1 and a second transistor MN2.

In the embodiment, the first transistor MN1 and the second transistor MN2 are, for example, NMOS transistors. The first transistor MN1 has a control terminal which serves as the input terminal of the source follower 370. A first terminal of the first transistor MN1 receives a system voltage Vss, and a second terminal of the first transistor MN1 serves as an output terminal of the source follower 370. The second transistor MN2 has a control terminal which receives a control voltage VB. A common voltage Vcom is received by a first terminal of the second transistor MN2, and a second terminal of the second transistor MN2 is coupled to the second terminal of the first transistor MN1. Therefore, an offset voltage Vth exists between an output terminal of the source follower and the input terminal of the source follower in the first voltage following module 360. Thus, as the timing of driving signals shown in FIG. 6, to reduce the voltage difference ΔV between the first data voltage V1 and the pixel voltage Vlc, the first shorting switch 580 may be controlled by the first shorting voltage Vto1, and thereby at least one of objects of the embodiment is achieved.

Figure 11:
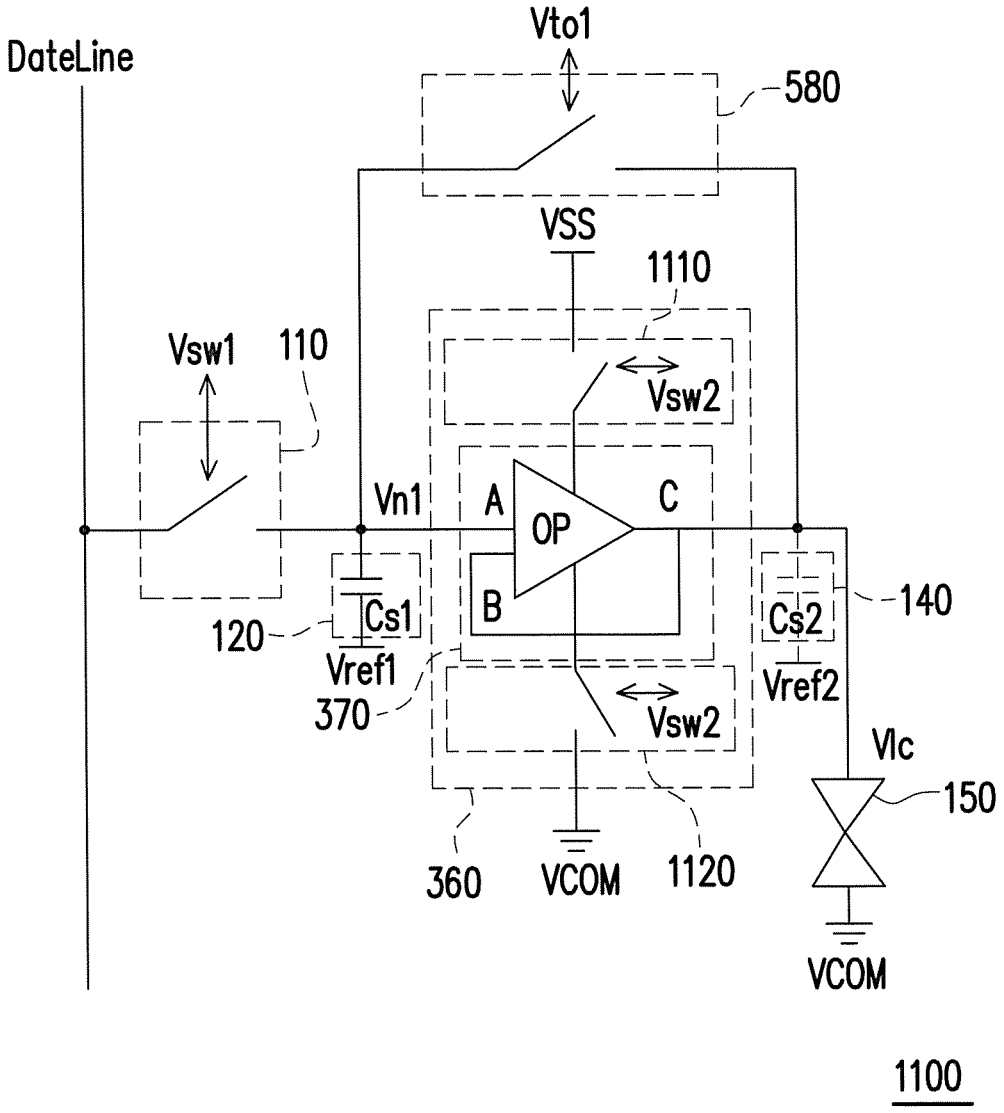
FIG. 11 is a schematic circuit diagram of a pixel circuitry of a display device according to the sixth embodiment of the invention.

Moreover, despite the mentioned implementation manner, the second switching voltage Vsw2 may be used to control a power supply of the operational amplifier OP so as to achieve the same effect of controlling the output terminal of the first voltage following module 360 by the second switching voltage Vsw2. Referring to FIG. 11, FIG. 11 is a schematic circuit diagram of a pixel circuitry of a display device according to the sixth embodiment of the invention.

The first voltage following module 360 of the pixel circuitry 1100 includes a first voltage follower 370, a first power control switch 1100, and a first power control switch 1120. An input terminal of the first voltage follower 370 serves as the input terminal of the first voltage following module 360, and an output terminal of the first voltage follower 370 serves as the output terminal of the first voltage following module 360. A first terminal of the first power control switch 1110 is coupled to a power input terminal of the first voltage follower 370, and a system voltage Vss is received by a second terminal of the first power control switch 1110. A first terminal of the first power control switch 1120 is coupled to a ground input terminal of the first voltage follower 370, and a common voltage Vcom is received by a second terminal of the first power control switch 1110.

Herein, the first power control switch 1110 and the first power control switch 1120 are both controlled by the second switching voltage Vsw2. Since the first voltage follower 370 is mainly implemented by an active element (e.g. the operational amplifier OP, or source follower, etc.), the first output voltage of the first voltage follower 370 is able to be controlled by controlling the power of the active element. Thus, when the second switching voltage Vsw2 is at a low level, the first power control switch 1110 and the first power control switch 1120 are turned off, so that the first voltage follower 370 is not able to generate the first output voltage. On the other hand, when the second switching voltage Vsw2 is at a high level, the first power control switch 1110 and the first power control switch 1120 are turned on so that the first voltage follower 370 is able to operate due to the power supply. Thus, the pixel voltage Vlc of the display element 150 is able to be further controlled so as to achieve at least one of objects of the embodiment.

The first voltage follower 370 of the embodiment includes an operational amplifier OP. A first input terminal A (e.g. a non-inverting input terminal) of the operational amplifier OP serves as the input terminal of the first voltage follower 370, an output terminal C of the operational amplifier OP is coupled to a second input terminal B (e.g. an inverting input terminal) of the operational amplifier OP and serves as the output terminal of the first voltage follower 370. Details of this embodiment have been described in the above embodiments and therefore not repeated hereinafter.

Figure 12:
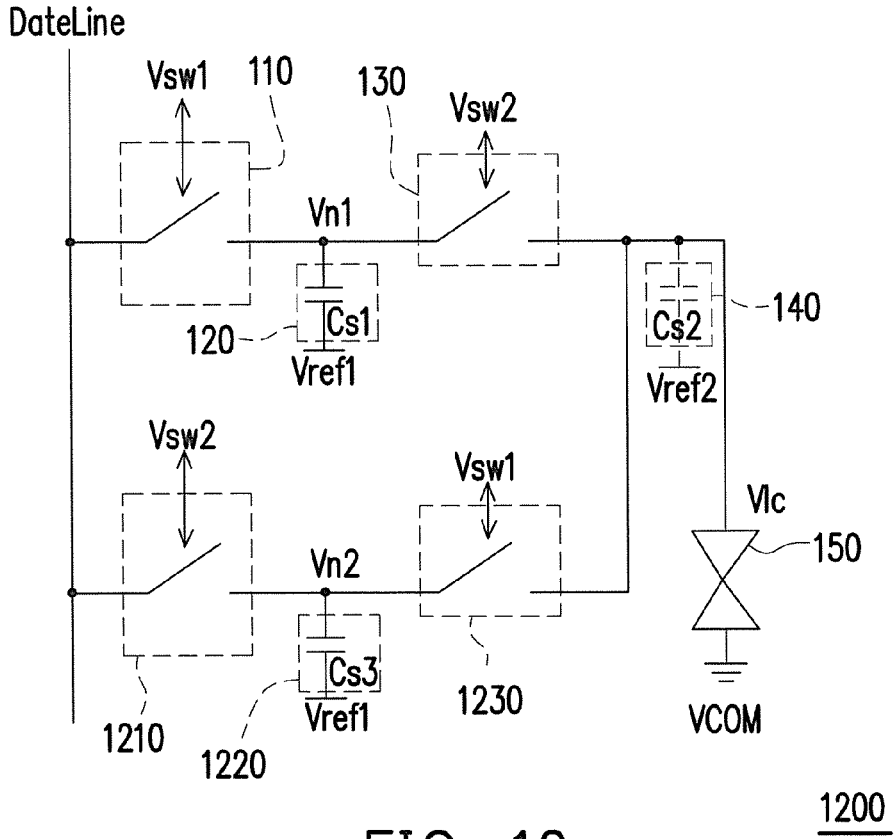
FIG. 12 is a schematic circuit diagram of a pixel circuitry of a display device according to the seventh embodiment.
Figure 13:
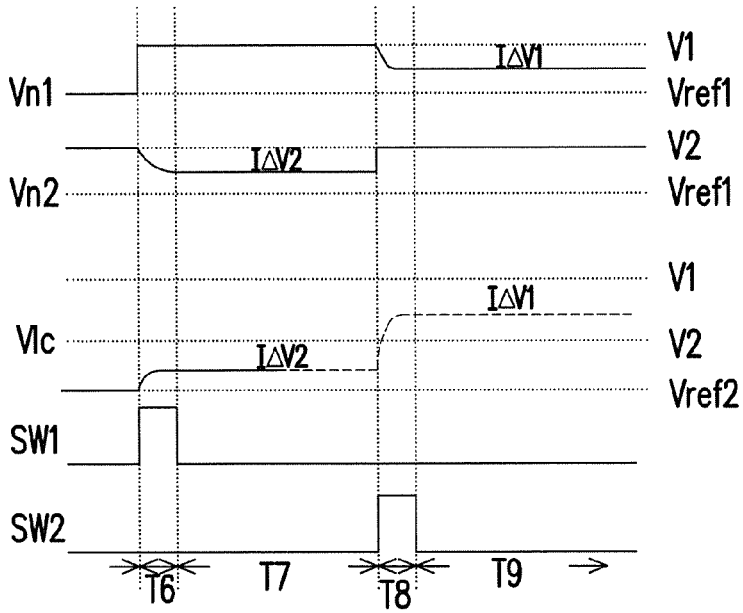
FIG. 13 is a timing diagram of driving signals of the pixel circuitry of a display device according to the seventh embodiment.

From another perspective, a pixel circuitry 1200 suitable for a display device is further provided in the seventh embodiment. Please refer to FIG. 12 and FIG. 13. FIG. 12 is schematic circuit diagram of the pixel circuitry 1200 of a display device according to the seventh embodiment. FIG. 13 is a timing diagram of driving signals of the pixel circuitry 1200 of a display device according to the seventh embodiment. The pixel circuitry 1200 includes a first write switch 110, a first write memory unit 120, a first display switch 130, and a display element 150. In addition, the pixel circuitry 1200 further includes a second write switch 1210, a second write memory unit 1220, and a second display switch 1230.

The second write switch 1210 has a first terminal coupled to a data line DataLine, and the second write switch 1210 is controlled by a third switching voltage. In the embodiment, the third switching voltage equals to the second switching voltage Vsw2. The second write memory unit 1220 is coupled to a second terminal of the second write switch 1210, wherein the second write memory unit 122 stores a second data voltage through the second write switch 1210. A first terminal of the second display switch 1230 is coupled to the second write memory unit 1220, wherein the first display switch 1230 is controlled by a fourth switching voltage. In the embodiment, the fourth switching voltage equals to the first switching voltage Vsw1. Besides, the pixel circuitry 1200 further includes a display memory unit 140 which includes a second capacitor Cs2. Details of this embodiment have been described in the above embodiments and therefore not repeated hereinafter.

The following illustrates the operation and process of the pixel circuitry 1200. In order to specifically illustrate the embodiment, a voltage of the first terminal of the first write memory unit 120 is called a first terminal voltage Vn1, and a voltage of the first terminal of the second write memory unit 1220 is called a second terminal voltage Vn2. According to the driving timing of the embedment, every two frames constitute a cyclic period, and thus each cyclic period has four periods. That is, a first write/second display period T6, a first latch period T7, a first display/second write period T8, and a second latch period T9.

During the first write/second display period T6, the first switching voltage Vsw1 is at a high level, and the second switching voltage Vsw2 is at a low level. Thus, the first write switch 110 and the second display switch 1230 are turned on, and the first display switch 130 and the first write switch 1210 are turned off. A first capacitor Cs1 in the first write memory unit 120 receives the first data voltage V1 through the data line DataLine of the first write switch 110, so that the voltage level of the terminal voltage Vn1 equals to the voltage level of the first data voltage V1.

A third capacitor Cs3 of the second write memory unit 1220 transmits the second data voltage V2 (i.e. the second terminal voltage Vn2) stored during the first display/second write period T8 to the LC capacitor 150. Ideally, the first data voltage V1 stored in the first capacitor Cs1 should be fully transmitted to the display element 150. However, due to the charge sharing, a voltage difference ΔV2 is formed between the pixel voltage Vlc (or the second terminal voltage Vn2) of the display element 150 and the second data voltage V2. At this time, the LC capacitor 150 displays pixels of the first frame according to the pixel voltage Vlc.

Then, the process enters the first latch period T7. During the first latch period T7, the first switching voltage Vsw1 and the second switching voltage Vsw2 are both at a low level. Thus, the first write switch 110, the second write switch 1210, the first display switch 130, and the second display switch 1230 are all turned off. At this time, the voltage level of the first terminal voltage Vn1 is kept at a voltage level equals to that of the first data voltage V1 by the first capacitor Cs1 of the first write memory unit 120. The voltage difference to drive the LC capacitor 150 is continuously maintained by the display memory unit 140 and a coupled capacitor in the LC capacitor 150, so that the LC capacitor is able to continuously display pixels of the first frame. In another embodiment, the display memory unit 140 may be omitted based on actual demands, and the data voltage is stored by the LC capacitor 150 itself.

Next, the process enters the first display/second write period T8. During this period, the second switching voltage Vsw2 is at a high level, and the first switching voltage Vsw1 is at a low level. Accordingly, during the first display/second write period T8, the first display switch 130 and the second write switch 1210 are turned on, and the first write switch 110 and the second display switch 1230 are turned off. Due to the charge sharing, an voltage difference ΔV1 is formed between the pixel voltage Vlc (i.e. the first terminal voltage Vn1) of the display element 150 and the first data voltage V1. At this time, the LC capacitor 150 displays pixels of the second frame according to the pixel voltage Vlc.

Then, the second latch period T9 starts. States of the switches during the second latch period T9 is similar to that during the first latch period T7. Specifically, the first write switch 110, the second write switch 1210, the first display switch 130, and the second display switch 1230 are turned off. Therefore, the voltage level of the terminal voltage Vn2 is kept at a voltage level equal to that of the second data voltage V2 by the third capacitor Cs3 of the second write memory unit 1220. The voltage difference to drive the LC capacitor 150 is continuously kept by the display memory unit 140 and the coupled capacitor in the LC capacitor 150 so as to maintain the display of pixels during the second frame until the next first write/second display period T6.

Figure 14:
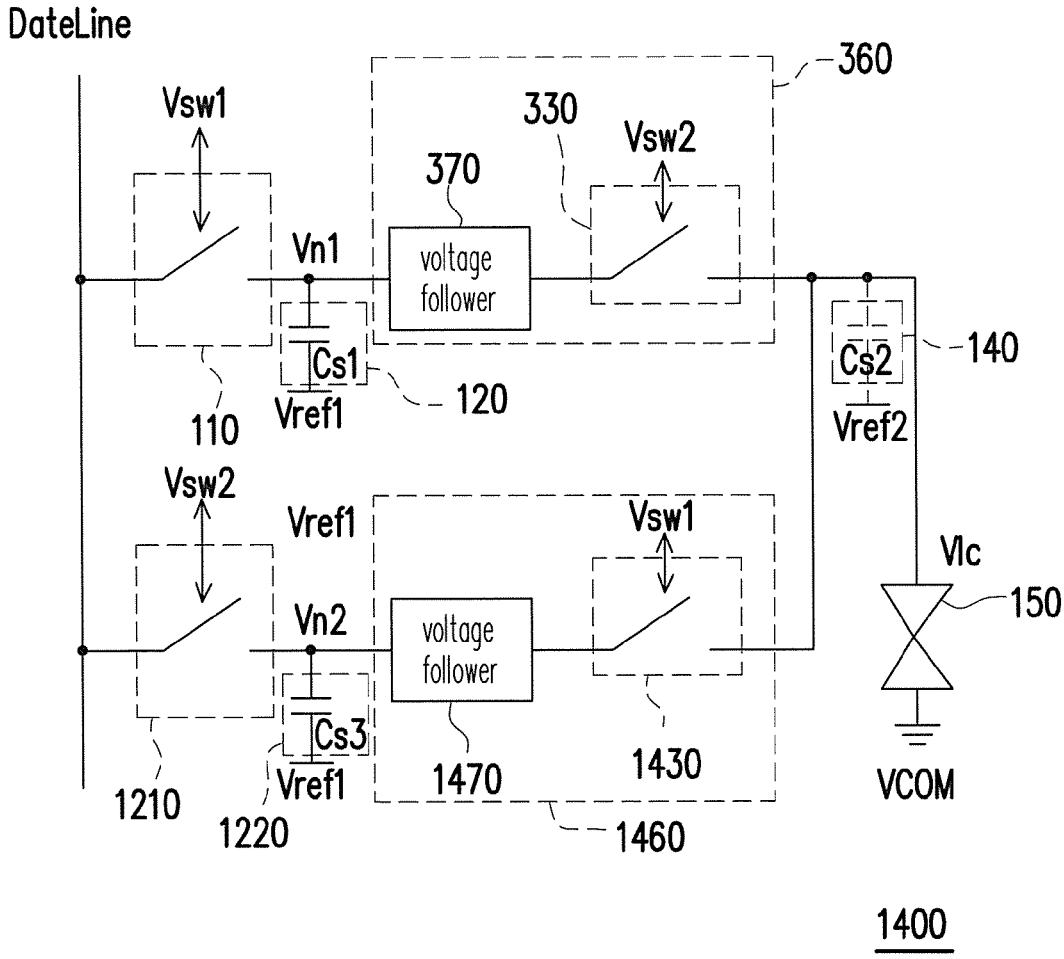
FIG. 14 is a schematic circuit diagram of a pixel circuitry of a display device according to the eighth embodiment of the invention.
Figure 15:
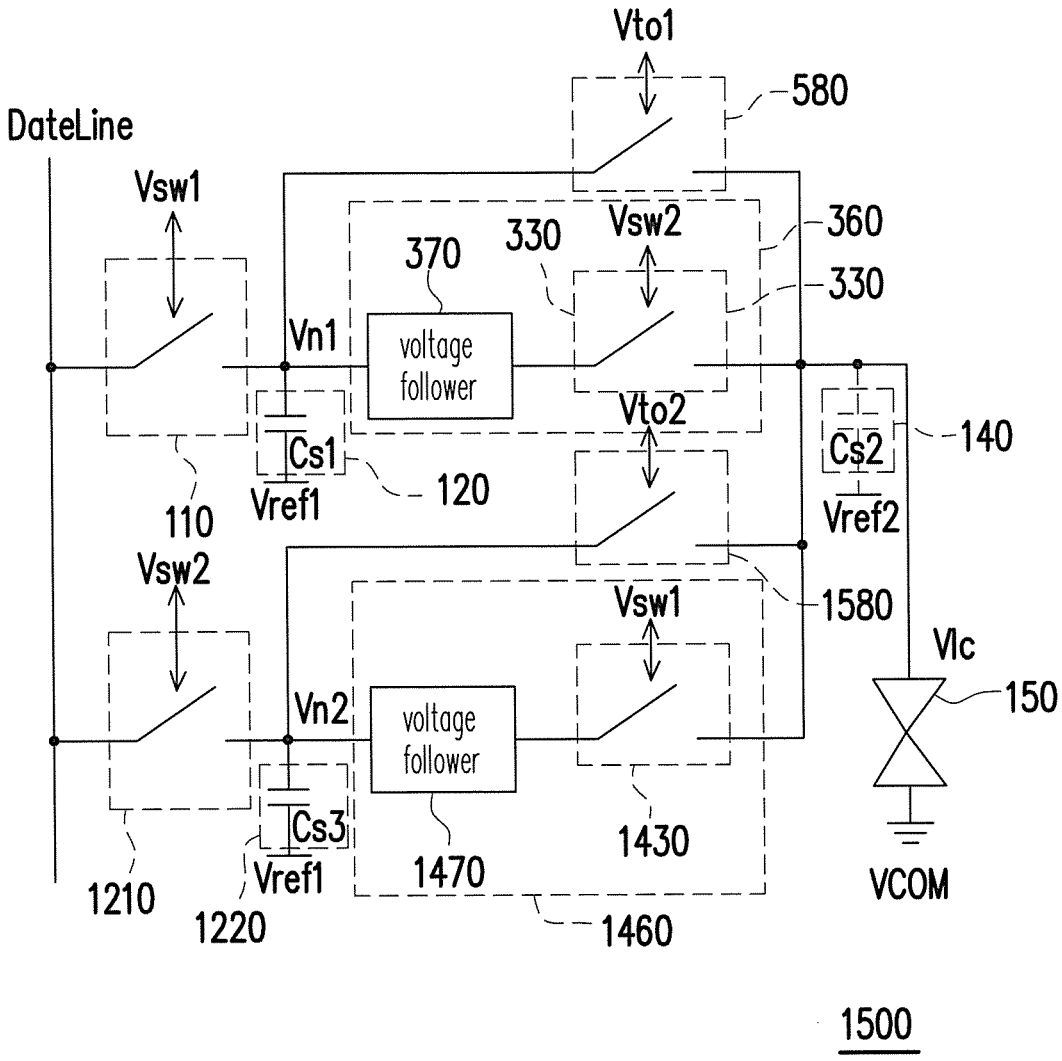
FIG. 15 is a schematic circuit diagram of a pixel circuitry of a display device according to the ninth embodiment of the invention.

Based on the above description, in order to reduce the voltage difference ΔV1 and the voltage difference ΔV2 as much as possible and the influence of the charge sharing, the eighth embodiment of the invention is further provided, wherein the pixel circuitry is able to faithfully transmit the data voltage to the LC capacitor 150. Please refer to FIG. 14 and FIG. 15, FIG. 14 is a schematic circuit diagram of a pixel circuitry of a display device according to the eighth embodiment of the invention. FIG. 15 is a schematic circuit diagram of a pixel circuitry of a display device according to the ninth embodiment of the invention.

The difference between the eighth and the ninth embodiments and the seventh embodiment lies in that a first voltage following module 360 and a second voltage following module 1460 are adopted in the eighth and the ninth embodiments for faithfully transmitting the data voltage to the LC capacitor 150, so that the voltage level of a pixel of the pixel circuitry is close to the voltage level of the received data voltage. An input terminal of the first voltage following module 360 is coupled to a first write memory unit 120, and an output terminal of the first voltage following module 360 is coupled to a display element 150. In the embodiment, the second voltage following module 1460 includes a second voltage follower 1470 and a second display switch 1430. Herein, the second voltage following module 1460 is similar to the first voltage following module 360, and thus descriptions of the same connection scheme and operation are not repeated. An input terminal of the second voltage following module 1460 is coupled to the second write memory unit 1220, and an output terminal of the second voltage following module 1460 is coupled to the display element 150.

Furthermore, in order to reduce the output error or the offset voltage of the first voltage following module 360 and the second voltage following module 1460, a first shorting switch 580 and a second shorting switch 1580 are further adopted in the eighth and the ninth embodiments so as to decreases the output error (or the offset voltage). Thus, the voltage level of the pixel voltage Vlc is able to be closer to a target voltage level (i.e. the voltage level of the first data voltage V1 or the voltage level of the second data voltage V2). That is to say, the voltage difference ΔV1 and the voltage difference ΔV2 are further decreased. Herein, a first terminal of the second shorting switch 1580 is coupled to the second write unit 1220, and a second terminal of the second shorting switch 1580 is coupled to the display element 150. Besides, the second shorting switch 1580 is controlled by the second shorting voltage Vto2. The same or similar details of the eighth and the ninth embodiments have been described in the above embodiments and therefore not repeated hereinafter.

Based on the above, in the embodiments of the invention, by adopting the voltage following module which mainly consists of an active element (e.g. an operational amplifier, or a source driver, etc.), the voltage level of the data voltage transmitted by the pixel circuitry is not affected by coupled capacitors and the charge sharing. Therefore, the voltage level of the display element is about equal to the voltage level of an image data voltage. If the voltage level of the pixel voltage is slightly decreased due to a voltage drop of a voltage following module when the voltage following module transmits the data voltage, a shorting switch may be added so that the voltage level of the pixel voltage is further close to the voltage level of the data voltage.

Although the invention has been described with reference to the above embodiments, it will be apparent to one of the ordinary skill in the art that modifications to the described embodiment may be made without departing from the spirit of the invention. Accordingly, the scope of the invention will be defined by the attached claims not by the above detailed descriptions.

What is claimed is:

1. A pixel circuitry of a display device, comprising:

a first write switch, having a first terminal coupled to a data line, the first write switch being controlled by a first switching voltage;

a first write memory unit, coupled to a second terminal of the first write switch, wherein the first write memory unit stores a first data voltage through the first write switch;

a first voltage following module, having an input terminal coupled to the first write memory unit to detect the first data voltage stored in the first write memory unit and to generate a first output voltage correspondingly at an output terminal of the first voltage following module according to a detection result, wherein the output terminal of the first voltage following module is controlled by a second switching voltage;

a display element, coupled to the output terminal of the first voltage following module to receive the first output voltage through the first voltage following module during a frame period;

a first shorting switch having a first terminal directly coupled to the first write memory unit, a second terminal of the first shorting switch being directly coupled to the display element, and the first shorting switch being controlled by a first shorting voltage;

a second write switch, having a first terminal coupled to the data line, the second write switch being controlled by a third switching voltage;

a second write memory unit, coupled to a second terminal of the second write switch, wherein the second write memory unit stores a second data voltage through the second write switch;

a second voltage following module, having an input terminal being coupled to the second write memory unit, an output terminal of the second voltage following module being coupled to the display element so as to detect the second data voltage stored in the second write memory unit and to generate a second output voltage correspondingly at the output terminal of the second voltage following module according to a detection result, wherein the output terminal of the second voltage following module is controlled by a fourth switching voltage; and a second shorting switch having a first terminal coupled to the second write memory unit, a second terminal of the second shorting switch being coupled to the display element, and the second shorting switch being controlled by a second shorting voltage.

2. The pixel circuitry of a display device as claimed in claim 1, wherein the first voltage following module comprises:

a first voltage follower, having an input terminal serving as the input terminal of the first voltage following module; and a first display switch, having a first terminal coupled to an output terminal of the first voltage follower, a second terminal of the first display switch serving as the output terminal of the first voltage following module, and the first display switch being controlled by the second switching voltage.

3. The pixel circuitry of a display device as claimed in claim 2, wherein the first voltage follower comprises an operational amplifier, a first input terminal of the operational amplifier serves as the input terminal of the first voltage follower, and an output terminal of the operational amplifier is coupled to a second input terminal of the operational amplifier so as to serve as the output terminal of the first voltage follower.

4. The pixel circuitry of a display device as claimed in claim 2, wherein the first voltage follower comprises a source follower.

5. The pixel circuitry of a display device as claimed in claim 1, wherein the first voltage following module comprises:

a first voltage follower, having an input terminal which serves as the input terminal of the first voltage following module, and an output terminal of the first voltage follower serving as the output terminal of the first voltage following module; and a first power control switch, having a first terminal coupled to a power input terminal of the first voltage follower, a second terminal of the first power control switch receiving a system voltage, and the first power control switch being controlled by the second switching voltage.

6. The pixel circuitry of a display device as claimed in claim 5, wherein the first voltage follower comprises a operational amplifier, a first input terminal of operational amplifier serves as the input terminal of the first voltage follower, and an output terminal of the operational amplifier is coupled to a second input terminal of the operational amplifier so as to serve as the output terminal of the first voltage follower.

7. The pixel circuitry of a display device as claimed in claim 1, wherein the first write memory unit comprises a first capacitor having a first terminal coupled to the second terminal of the first write switch, and a second terminal of the first capacitor receives a first reference voltage.

8. The pixel circuitry of a display device as claimed in claim 1, further comprising a display memory unit coupled to the output terminal of the first voltage following module.

9. The pixel circuitry of a display device as claimed in claim 8, wherein the display memory unit comprises a second capacitor having a first terminal coupled to the output terminal of the first voltage following module, and a second terminal of the second capacitor receives a second reference voltage.

10. The pixel circuitry of a display device as claimed in claim 1, wherein the second voltage following module comprises:

a second voltage follower, having an input terminal serving as the input terminal of the second voltage following module; and a second display switch, having a first terminal coupled to an output terminal of the second voltage follower, a second terminal of the second display switch serving as the output terminal of the second voltage following module, and the second display switch being controlled by the fourth switching voltage.

11. The pixel circuitry of a display device as claimed in claim 1, wherein the second voltage following module comprises:

a second voltage follower, having an input terminal which serves as the input terminal of the second voltage following module, and an output terminal of the second voltage follower serving as the output terminal of the second voltage following module; and a second power control switch, having a first terminal coupled to a power input terminal of the second voltage follower, a second terminal of the second power control switch receiving a system voltage, and the second power control switch being controlled by the fourth switching voltage.

* * * * *